US005673541A

United States Patent [19]

Arzuman et al.

[11] Patent Number: 5,673,541

[45] Date of Patent: Oct. 7, 1997

[54] APPARATUS AND METHOD FOR FORMING, FILLING AND SEALING A BAG

[75] Inventors: B. John Arzuman, Scarborough; Ronald Moroney, Woodbridge, both of Canada

[73] Assignee: Emplex Systems, Inc., Scarborough, Canada

[21] Appl. No.: 550,776

[22] Filed: Oct. 31, 1995

[51] Int. Cl.[6] ..... B65B 43/30; B65B 43/04

[52] U.S. Cl. ..... 53/459; 53/469; 53/284.7; 53/570

[58] Field of Search ..... 53/455, 459, 562, 53/570, 384.1, 373.6, 374.8, 469, 468, 284.7; 493/195, 229, 232, 234, 237, 238

[56] References Cited

U.S. PATENT DOCUMENTS

| | | | |
|---|---|---|---|
| 2,124,209 | 7/1938 | Poppe | 493/232 X |
| 2,153,848 | 4/1939 | Shea et al. | 493/232 |
| 3,390,617 | 7/1968 | Cloud et al. | 53/570 X |
| 3,599,388 | 8/1971 | Feingold | 53/455 |
| 3,682,051 | 8/1972 | Sengewald | 53/562 X |
| 3,812,649 | 5/1974 | Clancy . | |
| 3,965,653 | 6/1976 | Lerner | 53/570 |
| 4,253,292 | 3/1981 | Lipes . | |
| 4,291,517 | 9/1981 | Lipes . | |
| 4,418,513 | 12/1983 | Plahm | 53/373.6 X |
| 4,423,583 | 1/1984 | Carey | 53/384.1 X |
| 4,453,370 | 6/1984 | Titchenal | 53/455 |
| 4,493,684 | 1/1985 | Bolton | 493/234 |
| 4,546,596 | 10/1985 | Cherney . | |
| 4,581,874 | 4/1986 | Rechtsteiner et al. . | |
| 4,586,319 | 5/1986 | Ausnit . | |
| 4,726,170 | 2/1988 | Sawa et al. | 53/570 |
| 4,736,572 | 4/1988 | Fang et al. . | |
| 4,774,797 | 10/1988 | Colamussi et al. . | |
| 4,789,350 | 12/1988 | Honsel | 493/232 |
| 4,843,796 | 7/1989 | Furukawa . | |
| 4,846,779 | 7/1989 | Ohuchi | 493/232 |
| 4,848,064 | 7/1989 | Lems et al. . | |
| 4,912,907 | 4/1990 | Fang et al. . | |
| 4,946,431 | 8/1990 | Jensen | 493/195 |
| 5,077,958 | 1/1992 | Peppard et al. | 53/373.6 X |
| 5,086,609 | 2/1992 | Tetenborg . | |
| 5,115,619 | 5/1992 | Lieder . | |

OTHER PUBLICATIONS

Triangle Acceleron of Form–Fill–Seal, H–100 Autobag, Reduce Your Packaging Costs with the Simple, High–Speed Autobag H–100 Packaging System.

*Primary Examiner*—Horace M. Culver
*Attorney, Agent, or Firm*—Darby & Darby

[57] ABSTRACT

An apparatus for forming, filling and sealing a pre-formed bag has a top sheet and a bottom sheet. The bag has a leading edge seal, a trailing edge seal, a bottom edge seal and an open top edge with an upper portion extending therefrom. The apparatus includes a back plate, a slotted front plate disposed adjacent to the back plate. The slotted front plate and the back plate clamps a portion of the bag disposed below the top edge. The front and back plate extend from the trailing edge to the leading edge. A pair of gripping fingers clamp the leading edge and the trailing edge adjacent to and below the front plate. A pair of pins each have a distal end that moves from a first limit position to a second limit position. In the first limit position, the distal end of the pins are spaced from the bottom sheet. In the second limit position, the distal end of the pins penetrate through the bottom sheet and clamp the top sheet against the front plate.

25 Claims, 10 Drawing Sheets

APPARATUS AND METHOD FOR FORMING, FILLING AND SEALING A BAG

BACKGROUND OF THE INVENTION

1. Field of the Invention

The present invention relates to methods and apparatuses for forming, filling and sealing a bag.

2. Discussion of the Related Art

It is generally known to use plastic film as a packaging material in the form of bags, pouches or a wrap. For example, U.S. Pat. No. 4,546,956 to Cherney discloses an apparatus for forming, filling and sealing packages in which a pouch is formed from a single web of flat flexible film. The film is fed from a roll over a collar shaped device that forms the film into a tube around a product filling tube T. The two film edges are then sealed together. As the tube moves down through the machine, two horizontal sealing bars come together to form a heat seal which forms the bottom of the pouch. At that point, a predetermined amount of product is allowed to flow through the product filling tube T and into the just formed pouch. By the time the pouch is filled, the top of the pouch has traveled down to the sealing bar location S where the bars 17*a*, 17*b* once again meet to simultaneously create the top seal of the bag and the bottom seal of the next pouch thereabove. The sealing bars 17a and 17b are equipped with a knife 71 which cuts through the seal and thus separates the filled pouch from the machine. This type of machine requires highly skilled maintenance personnel to reload or adjust the machine when the package size needs to be changed to suit a product having a different size. Accordingly, this type of system is most effective in dedicated, high speed, high volume packaging applications, where the same size product is always packaged.

Another apparatus for packaging material is taught by U. S. Pat. No. 4,253,292 to Lipes which utilizes a supply of wicketed bags 11'. The bags 11' are located in the unit in a vertical configuration and are held in the machine by wicket pins 12. The bag opening means 21 includes an air jet 36 which is positioned adjacent to the mouth opening 15 of the bag. The air jet 26 is actuated to open the top of the bag so that the product may be loaded into the bag. Once the bag is opened, an insert end portion 37 of a retractor member 38 is positioned within the opening 15. After the predetermined quantity of a product is inserted within the bag 11, the bag is released and is free to fall due to the force of gravity. The loaded open bag is dropped onto a platform which activates a heat seal bar to close the top of the package. This type of system does not produce a very neat fineshed package due to the occasional misalignment of the bag as it drops into the sealer. This results in a crooked or wrinkled bag closure, which detracts from the appearance of the finished package. Additionally, this type of system is best suited for contents which tend to be flat, regularly shaped objects rather than loose or bulky objects.

Another system presently utilizes a "bag on a roll" and is currently available as a model H-100 Auto Bag, which is a product of Automated Packaging Systems of Streetsboro, Ohio. This type of machine utilizes a roll of pre-fabricated bags which are mounted on a spindle in the machine. The bags are fed to a fill station where they are opened under a filling chute. The bags are then filled either manually or automatically. Upon completion of the filling cycle, the machine activates a sealer which closes the bag and separates the package at the perforation line from the main roll of bags. Thereafter, a new bag is indexed and is opened under the filling chute. A problem with this type of system is that the user is required to use pre-fabricated "bags on a roll" to utilize this machine. Thus, the user is required to utilize relatively expensive bags to operate this machine. Thus, there is a need in the art to produce a new forming, filling and sealing machine which utilizes low cost packaging material.

It is a further object of the present invention to provide a form, fill and seal machine that produces bags in an infinite range of bag sizes.

It is a further object of the present invention to provide a machine that loads the bag in a "top open" configuration when ready for filling.

It is a further object of the present invention to permit the bag to be filled by either a manual or automatic filling device.

It is a further object of the present invention that the machine be capable of sealing the fried package to produce a neatly finished package of the finest aesthetic quality.

It is a further object of the present invention that the form, fill and seal machine be capable of being operated by personnel having minimal training.

It is a further object of the present invention that the machine be ruggedly constructed and extremely reliable while also being compact and easily mobile.

It is a further object of the present invention that the machine operate at a reasonably high production rate.

It is a further object of the present invention to provide a form, fill and seal machine that requires less parts and, thus, is smaller and easier to manufacture.

It is a further object of the present invention that the form, fill and seal machine be cost effective to manufacture, yet reliable and efficient to use.

SUMMARY OF THE INVENTION

In a preferred embodiment demonstrating features, objects and advantages of the present invention an apparatus and method for forming, filling and sealing a bag having a top sheet and a bottom sheet. The bag has a leading edge seal, a trailing edge seal, a bottom edge seal and an open top edge with an upper portion extending therefrom. The apparatus includes a back plate. A slotted front plate is disposed adjacent to the back plate. The slotted front plate and the back plate clamp a portion of the bag disposed below the top edge. The front and back plate extend from the trailing edge to the leading edge. A pair of pins each has a distal end that moves from a first limit position to a second limit position. In the first limit position, the distal end of the pins are spaced from the bottom sheet. In the second limit position, the distal end of the pins penetrate through the bottom sheet and clamp the top sheet against the front plate. The method includes positioning the preformed bag between the back plate and the slotted from plate. A portion of the bag disposed below the top edge is clamped between the front plate and the back plate. The leading edge and the trailing edge of the bag is clamped at a position adjacent to and below the front and the back plate with a pair of gripping fingers. The bag is opened by moving a pair of pins from a fast limit position where the pins are spaced from the bottom sheet of the bag to a second limit position where the pins penetrate through the bottom sheet and clamp the top sheet against the front plate thereby forming an opening in the top of the bag.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
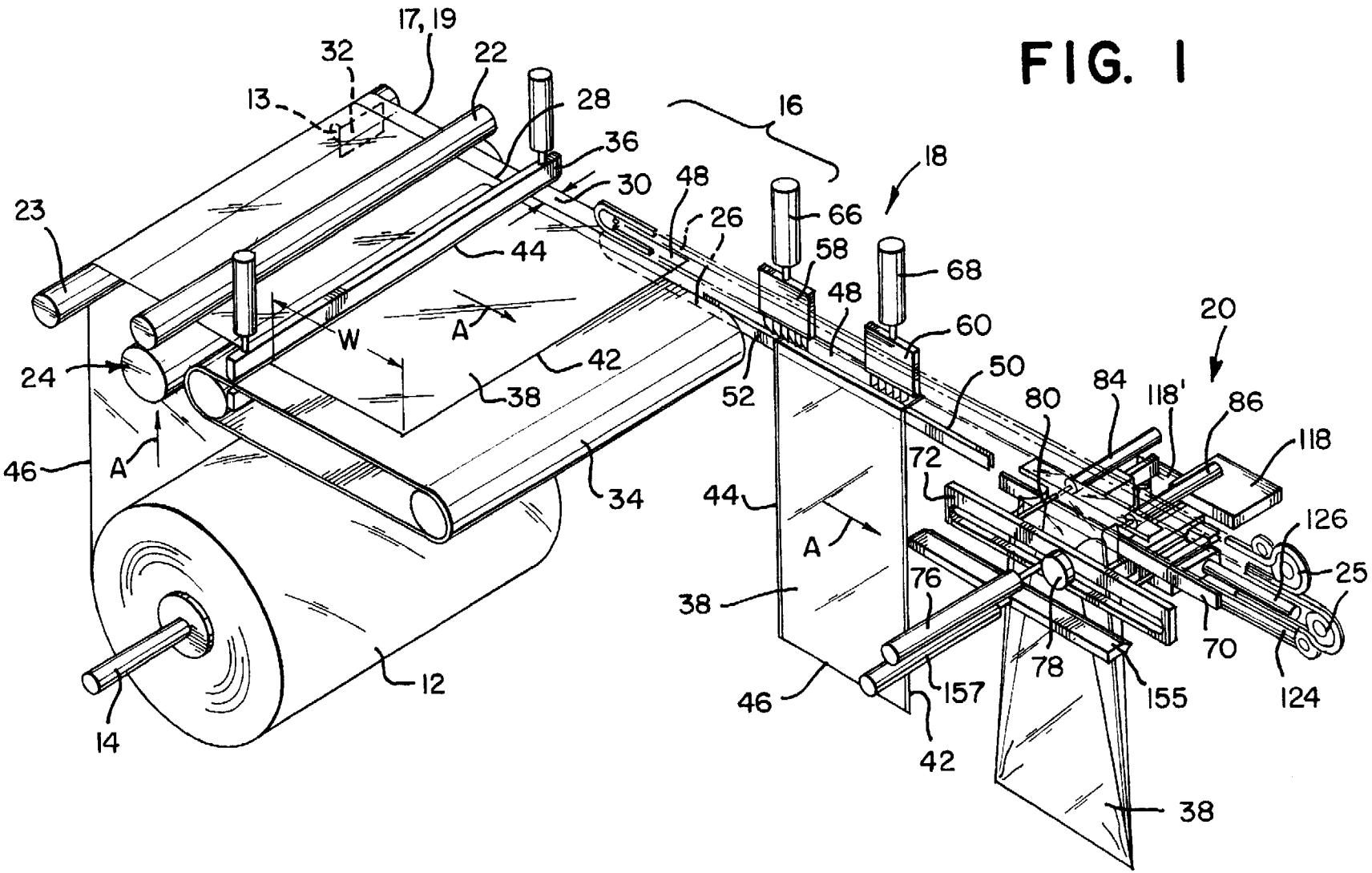
FIG. 1 is a perspective view of the form, filling and sealing apparatus according to the present invention.

Referring to FIG. 1, an apparatus 10 for forming, filling and sealing a bag is illustrated and includes a roll of U-folded film 12, a cutting member 13, a bag forming station 16, a bag perforator station 18 and a bag open, fill and seal station 20.

The roll of U-folded film 12 is rotatably mounted on a spindle 14. The U-folded film 12 is comprised of a sheet of plastic film that is folded in half such that it has a folded end 46 and open or free ends 17, 19. Accordingly, the roll of film 12 is "U-folded" film and includes a top sheet and a bottom sheet. The top sheet has an upper free end 17 and a lower folded end 46, and the bottom sheet has an upper free end 19 and a lower folded end 46, which is common with the folded end of the top sheet; it being understood that relative orientation adjectures such as "upper", "lower" "horizontal", "vertical", etc. are utilized herein to simplify the present description and are not intended to limit the orientation of the forming, filling and sealing apparatus when mounted for use. The free ends 17, 19 of the top and bottom sheet are substantially aligned with respect to each other because the sheet is preferably folded evenly in half. The U-folded film is unwound from the roll so as to travel along a predetermined path A which is, in pan, defined by an idle roller 23, driving feed rollers 22, 24 and in-feed chains 26.

Before reaching idle roller 23, the U folded film 12 passes by the cutter member 13 which cuts only the top sheet of the U-folded film to form a slit 28 in the top sheet. Slit 28 is disposed substantially parallel to the free end 17 of the U-folded film and is spaced from the free end 17 by a predetermined first distance 30. In a preferred embodiment, distance 30 is approximately 1". However, this distance will vary depending, inter alia, upon the size of the U-folded film and the contents to be filled within the formed bag. To ensure that only the top sheet of the U-folded film is cut, a plate 32 is disposed between the top sheet and the bottom sheet in juxtaposed position with respect to the cutter member 13. Plate 32 is positioned to prevent cutter member 13 from contacting the bottom sheet.

After passing the cutter member 13, the U-folded film 12 is then deflected by idle roller 23 to the driving rollers 22, 24 feed the film 12 to the bag forming station 16. Film 12 is supported in the bag forming station 16 by a horizontal conveyor belt 34. The driving rollers 22, 24 intermittently feed a predetermined amount of film 12 into the bag forming station 16 and then a brake is applied to the driving rollers 22, 24 to stop the further feeding of the film 12. The length of the film 12 which is fed into the bag forming station 16 is equal to the preferred bag width W. The length of the bag depends directly upon the width of the roll 12 which is used. Therefore, if a longer length bag is required, then a wider roll should be used.

Figure 2:
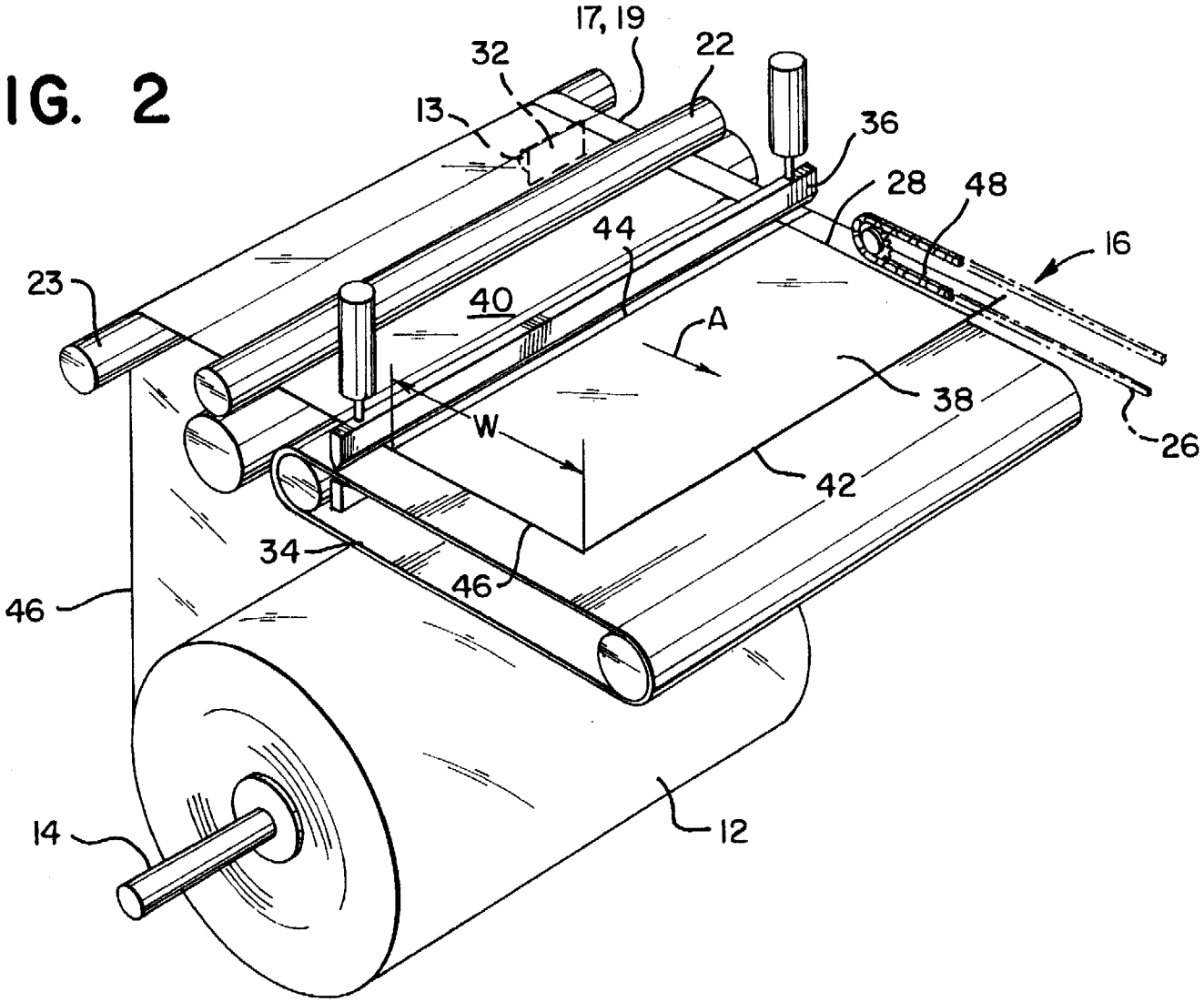
FIG. 2 is a perspective view of the bag forming station according to the present invention.

After moving to the bag forming station 16, heated cut/seal blade 36 then clamps down upon the film 12. Blade 36 extends from the free ends 17, 19 to the folded ends 46 in a direction substantially perpendicular to the feed direction A (i.e., perpendicular to the free ends 17, 19 and to the folded ends 46 of the film) to simultaneously produce the trailing side welded edge 44 of the current bag 38 and the leading side welded edge 42 of the next bag 40 (See FIGS. 1–2). The heated cut/seal blade member 36 itself is of conventional structure. The beg 38 is now comprised of a sealed leading edge 42, a sealed trailing edge 44, a folded bottom edge 46 and a slit open top edge 28 disposed in the top sheet. The folded bottom edge 46 provides a bottom edge seal for the bag.

At the top edge, the bag 38 is not sealed to provide access to the bag 38 in the downstream filling and sealing station 20. In the bag forming station 16, a top portion 48 of the bag is fed into meshing in-feed chains 26 at a predetermined distance from the free ends 17, 19, which is approximately half of the distance 30. Thus, in the preferred embodiment, the in-feed chains are disposed at approximately ½" from the free ends 17, 19 of the bag 38. The in-feed chains are intermittently driven by drive sprockets 25.

Bag 38 has effectively been transferred from a U-folded film into a J-folded film due to slit 28. The in-feed chains 26 grasp the top portion 48 of the bottom sheet as well as the top portion 48 of the top sheet disposed above slit 28. However, the portion of the upper sheet held by the in-feed chains is no longer needed and therefore one could simply start with a roll of J-folded film which has been previously cut at area 28. Such a film will not lie uniformly on a spindle, especially at the slit edge and it is therefore currently preferred to use U-folded film because it is easier to handle in this manufacturing step.

Once the trailing edge 44 is formed, bag 38 is transported by the in-feed chains 26 to the bag perforator station 18. As the bag 38 leaves the horizontal conveyor belt 34, the bag will hang vertically downwardly from the in-feed chains.

Figure 3:
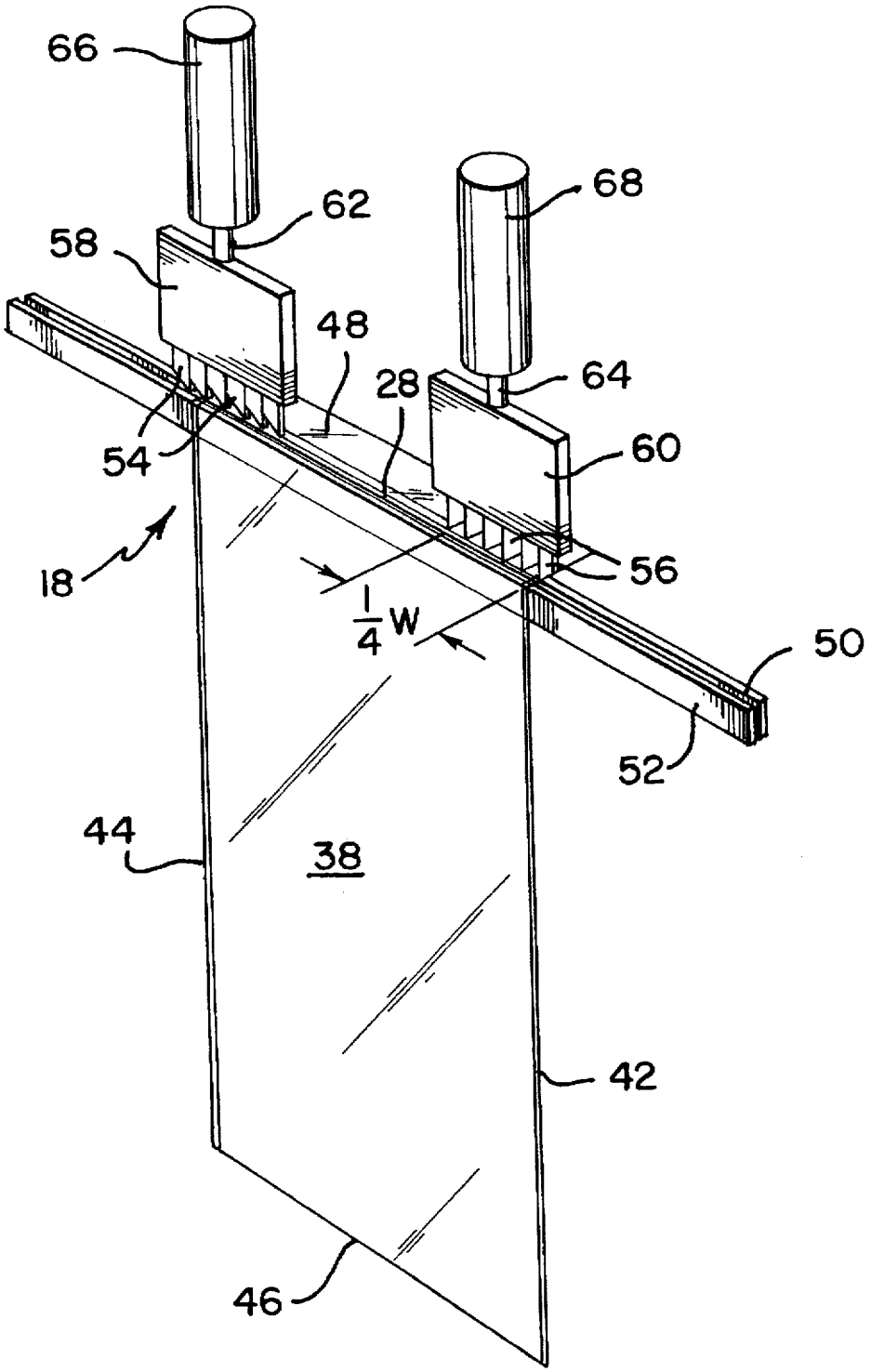
FIG. 3 is a perspective view of the bag perforator station according to the present invention.

Referring now to FIG. 3, the bag perforator station 18 is illustrated. For the sake of clarity in the drawings, in-feed chains 26 are not illustrated in FIG. 3. In the bag perforator station 18, the top portion of the bag 48 is supported by the in-feed chains and by a spaced apart pair of film supporting plates 50, 52. The plates 50, 52 are disposed in alignment with the slit 28 in the top sheet so that as the bag 38 is draped over plates 50, 52, the slit is disposed between the two plates 50, 52. Once the bag 38 has reached the position illustrated in FIGS. 1 and 3, the feeding of the bag by the in-feed chains is stopped. A first plurality of cutting members 54 and a second plurality of cutting members 56 are disposed above plates 50, 52 and are aligned with the leading edge 42 and the trailing edge 44 of the bag, respectively. The plurality of cutting members or blades 54, 56 are each fixedly mounted to a blade holder 58, 60, respectively. Each blade holder 58, 60 is actuated in a downward direction by a pin 62, 64, respectively, which are each actuated by pneumatic cylinders 66, 68. The blades 54, 56 move from a position illustrated in FIG. 3 to a position in which they extend through the bottom sheet of the bag 38, and between plates 50, 52. In a preferred embodiment, the blades 54, 56 are approximately ⅜ of an inch wide and the distance between each blade member is approximately 1 mm to thereby create the perforations 154, 156 in the bottom sheet (see FIG. 4). The length of the perforations 154, 156 on each side of the bag is preferably one-fourth the width W of the bag. Thus, when the bag is to be opened in the bag open, fill and seal station 20, the bag will open to a substantial square shaped opening. However, if a rectangular shaped opening is desired, the length of the perforations should be adjusted to be less than one-fourth of the width of the bag.

Figure 4:
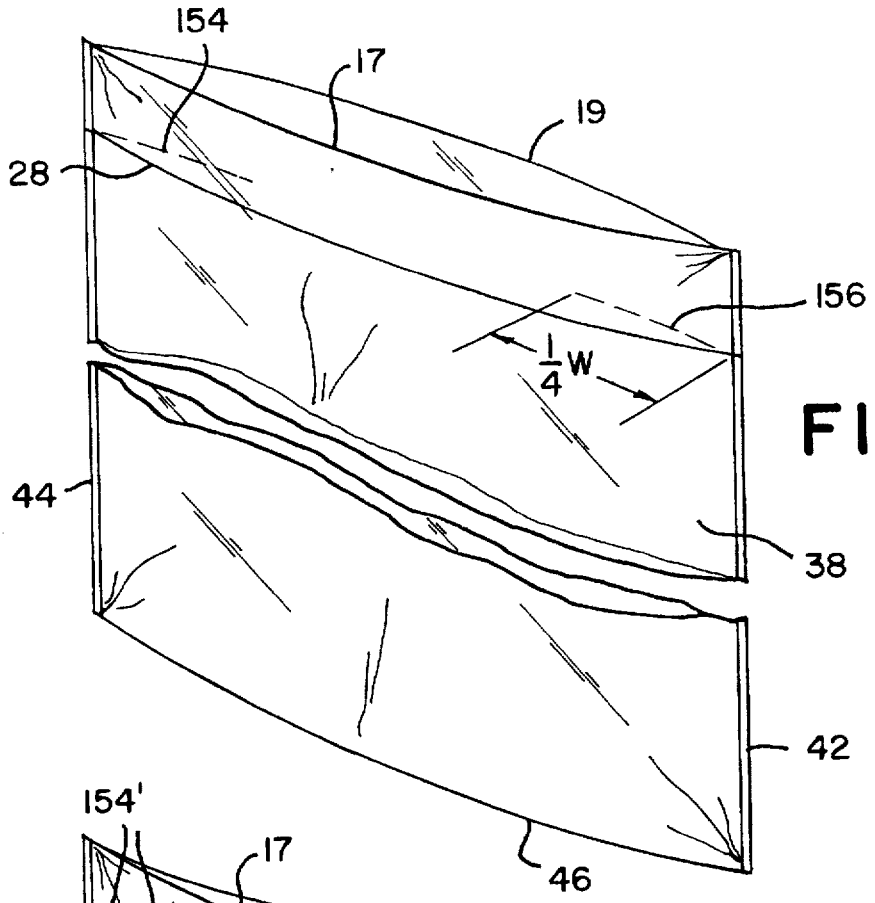
FIG. 4 is a perspective view of the bag having perforations in the back sheet.

FIG. 4 illustrates the bag 38 after it has been perforated by blades 54, 56. The top sheet of the bag is illustrated having its slit 28; whereas the back sheet is illustrated as being perforated at a position that substantially aligns with and is parallel to slit 28. The front and back sheets are illustrated as being spaced apart from one another for the sake of clarity in illustrating the perforations 154, 156 and the slit 28. However, the front sheet and back sheet are more accurately illustrated as being in contact with one another in FIG. 3.

The blades 54, 56 do not perforate the front sheet because the blades 54, 56 penetrate through the slit 28 of the front sheet which is disposed about plates 50, 52. The back sheet is preferably perforated as opposed to simply being cut from each side edge so that during transport of the bag from the bag perforator station 18 to the bag open, fill and seal station 20, the bag is less likely to open if it were to "catch" air during transport. In other words, the bag is more likely to be unintentionally opened if it is exposed to a gust of air when the back sheet is completely cut, rather than being perforated. After the blades 54, 56 form the perforations, the pneumatic cylinders 66, 68 are actuated to retract the blade holders 58, 60 to their original position as illustrated in FIG. 3. The bag 38 is then ready to be transported to the bag open, fill and seal station 20.

Figure 5:
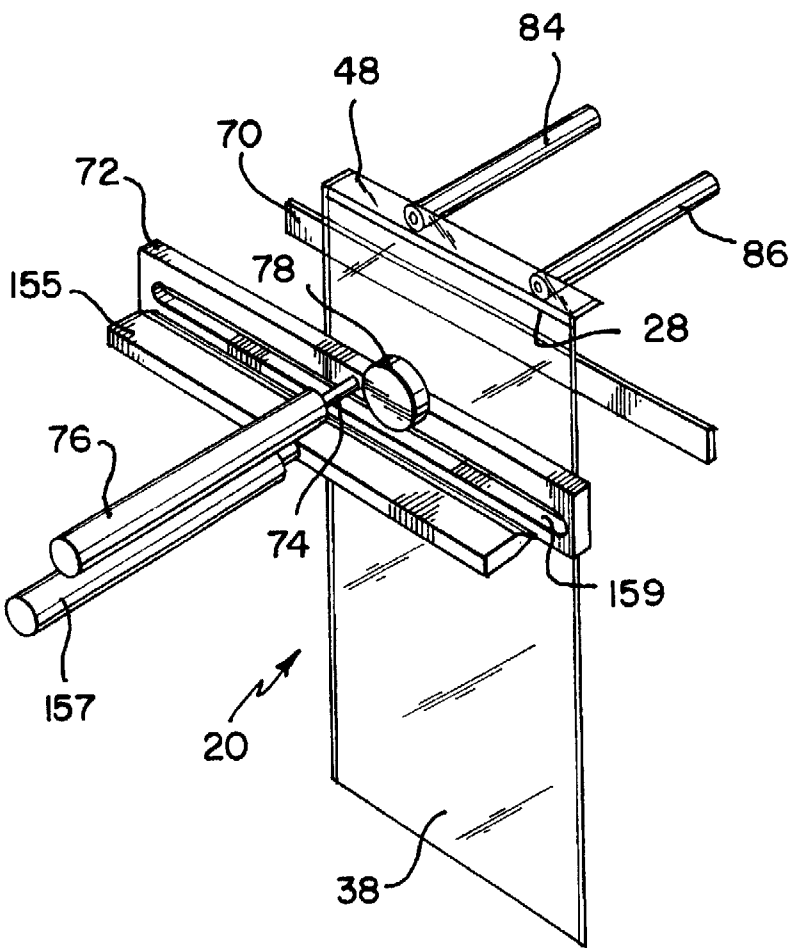
FIG. 5 is a perspective view of the bag disposed between the front clamp and the back clamp.

Referring now to FIG. 5, upon receipt of the bag 38 in the bag open, fill and seal station 20, the bag is positioned so that it is disposed between a backup sealing strip 70 and a from slotted plate 72. The from slotted plate 72 is actuated forward (i.e., toward backup sealing plate 70) to clamp bag 38 between back plate 70 and front plate 72. The front plate 72 is preferably actuated by a pin 74, which is preferably actuated by a pneumatic cylinder 76. The upper portion 48 of the bag is supported in a horizontal position by the in-feed chains 26. The bag is draped over from the horizontal portion such that the slit 28 is disposed in the vertical portion of the bag 38 (i.e., the portion of the bag draping downwardly from the in-feed chains 26, see FIG. 5). Slit 28 is disposed above the front plate 72 and above back up plate 70, as illustrated in FIG. 5. The retraction of from plate 72 away from back plate 70 is limited by the position of an adjustable stop 78.

Figure 6:
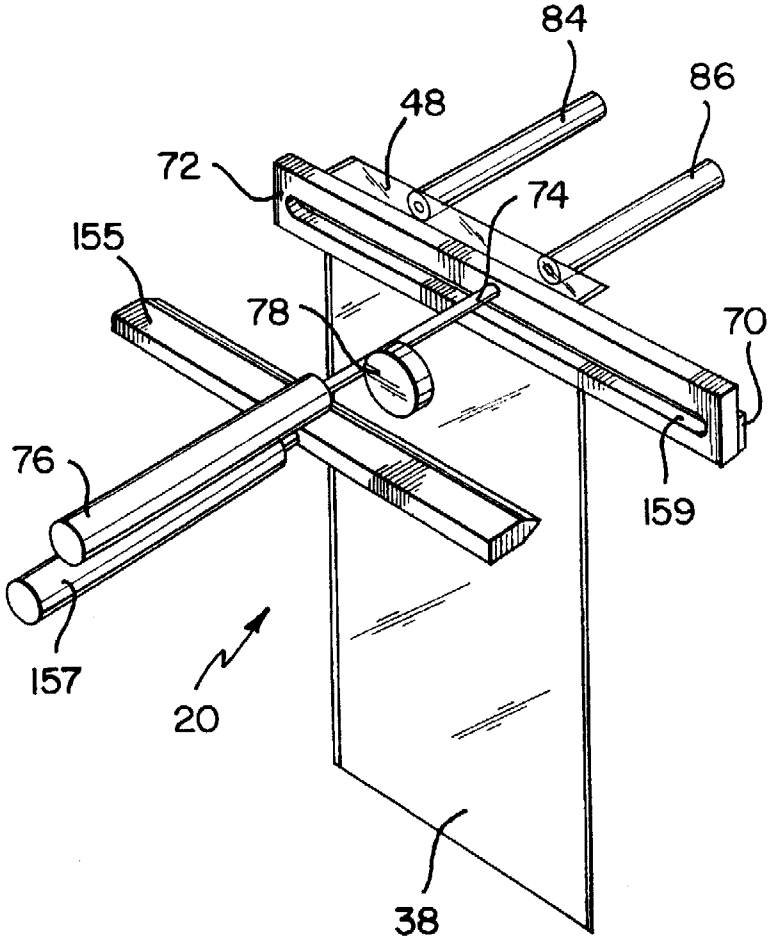
FIG. 6 is a perspective view of the bag being clamped between the front clamp and the back clamp.
Figure 7:
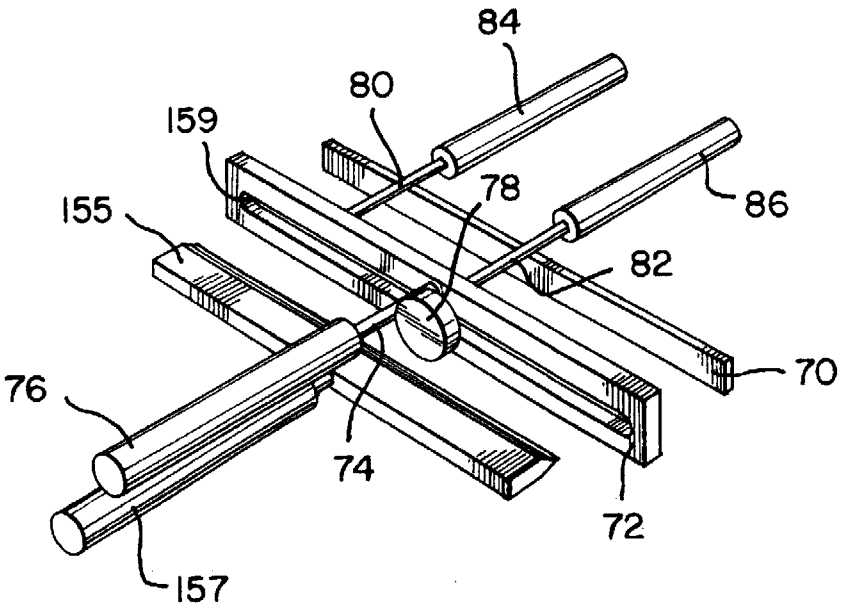
FIG. 7 is a perspective view of the bag piercing pins extending against the front plate without the bag being illustrated.

Referring now to FIG. 7, the bag open, fill and seal station 20 is illustrated without bag 38 for the sake of clarity. A pair of pins 80, 82 are disposed behind back plate 70. Pins 80, 82 are disposed above backup plate 70 and are actuatable towards front slotted plate 72 by a pair of pneumatic cylinders 84, 86. Upon receipt of a bag within the bag open, fill and seal station 20, the slotted front plate 72 is actuated toward backup plate 70 by pin 74 to the position illustrated in FIG. 6.

Figure 8:
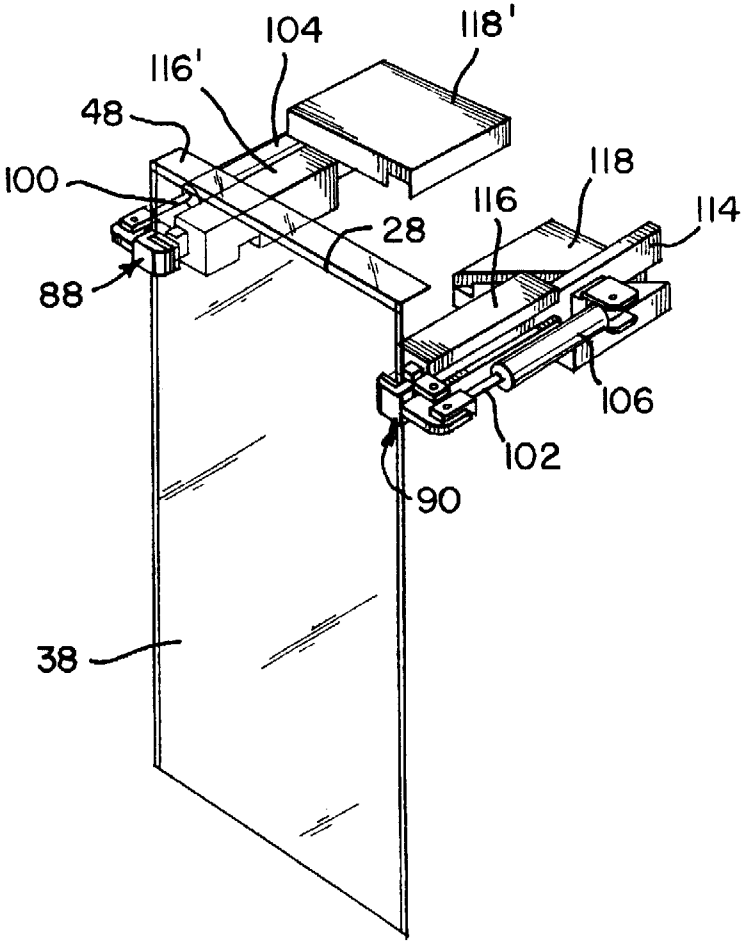
FIG. 8 is a perspective view of a bag being held by the gripping fingers.
Figure 9:
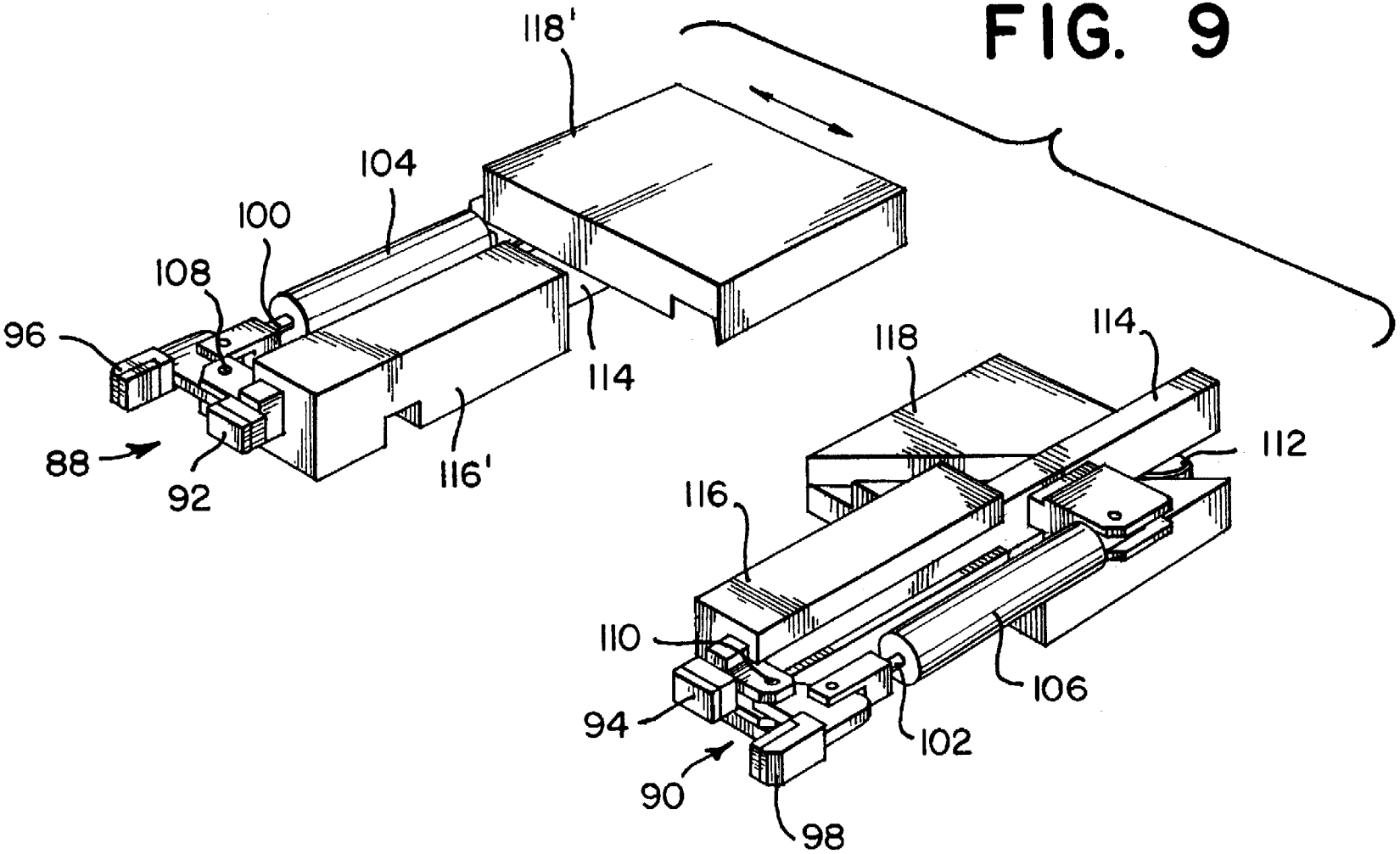
FIG. 9 is a perspective view of the gripping fingers and their actuator assemblies.

Once the top of the bag has been clamped between plates 70, 72, a pair of gripping fingers 88, 90 (FIG. 8) clamp each side of the bag 38. The gripping fingers 88, 90 are disposed below the backup plate 70 and the front plate 72 as illustrated in FIG. 1. Referring now to FIGS. 8 through 11, each finger 88, 90 is comprised of a fixed finger clamp 92, 94 and a pivoting finger clamp 96, 98, respectively. The pivoting fingers 96, 98, are actuated by a reciprocating pin 100, 102, which are actuated by air cylinders 104, 106, respectively. Referring to FIG. 9, the pins 100, 102 are shown in the retracted position and the gripping fingers 88, 90 are shown in the open position. After the top of the bag has been clamped between the backup plate 70 and the from plate 72, the pneumatic cylinders 104, 106 are actuated such that the pins, 100, 102 move in the forward direction towards the front plate causing the pivoting fingers 96, 98 to pivot about pins 108, 110, respectively and thereby grip the leading and trailing edge of the bag 38 as illustrated in FIG. 8. The grippers position the bag in the fill station, support the bag during the ling operation and close the top of the bag tightly during the sealing operation. Each gripper also includes a cam follower 112 (the cam follower for the trailing edge gripper is hidden from view in FIGS. 8 and 9). Each cam follower is connected to a slide bar 114. The slide bar 114 reciprocates in a slide block 116, 116' by following an adjustable 45 degree angle cam 118. Thus, the slide bars 114 reciprocate in a horizontal direction perpendicular to the surface of the bag.

Figures 10, 11:
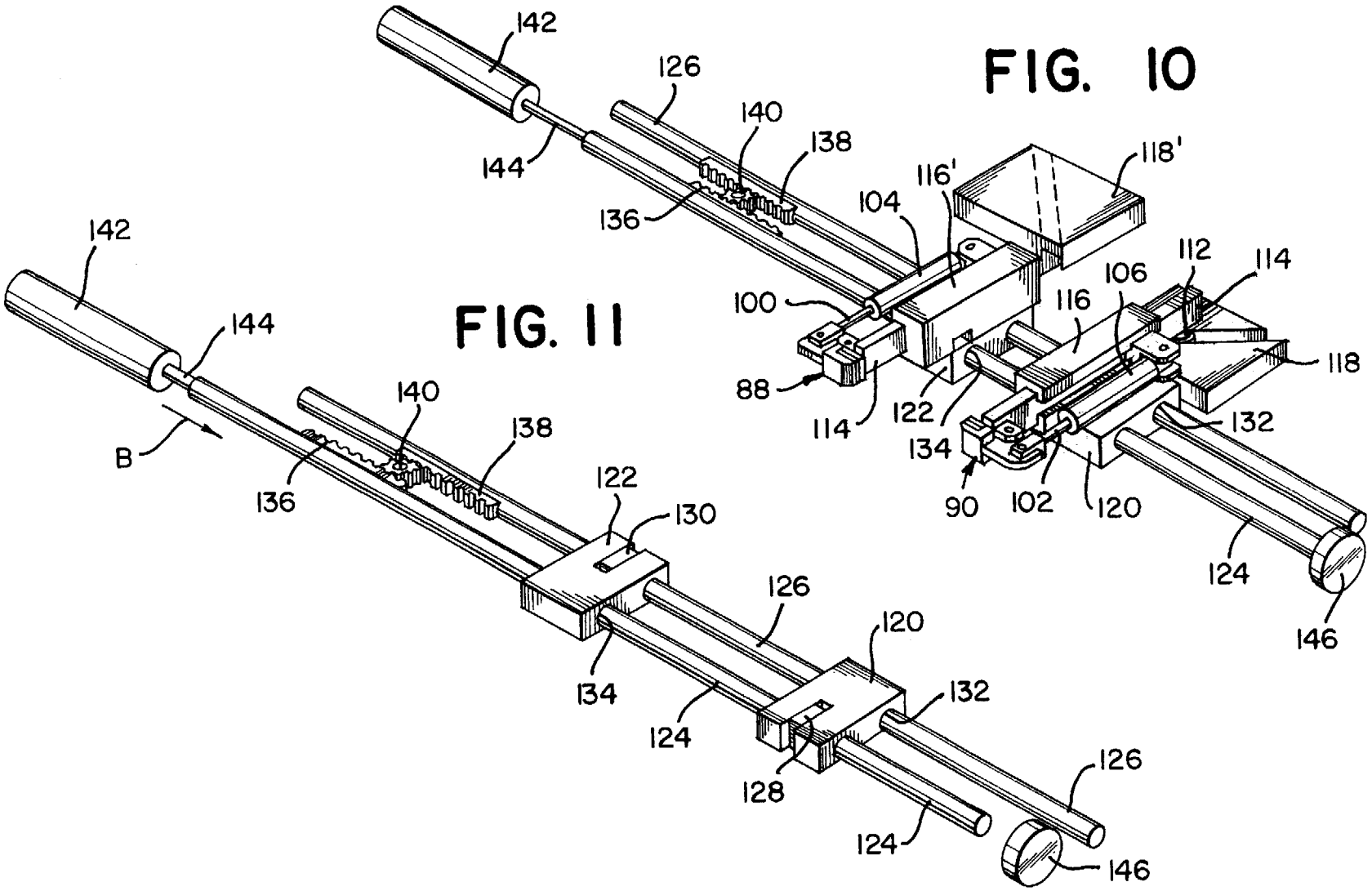
FIGS. 10 and 11 are perspective views of the carriage shafts for the gripping fingers.

The slide block 116 for the leading edge gripper 90 is fixedly mounted on an adjustable carriage 120 (see FIGS. 10 and 11). Similarly, slide block 116' for the trailing edge gripper 88 is fixedly mounted on carriage 122. Carriage 120 is adjustably fixed to carriage shaft 124, whereas carriage 122 is adjustably fixed to carriage shaft 126. Each carriage 120, 122 includes a shaft locking collar 128, 130, respectively so that its position with respect to the shaft can be adjusted. The carriages in FIG. 11 are illustrated as having a minimum distance therebetween (i.e., corresponding to a bag open position). Carriage 120 includes a second through bore 132 which receives carriage shaft 126 to guide the reciprocal movement of carriage 120 so that carriage 120 will not be permitted to rotate about shaft 124. Likewise, carriage 122 includes a through bore 134 to guide the reciprocal movement of carriage 122 while not permitting carriage 122 to rotate about shaft 126. Shafts 124, 126 reciprocate in opposite directions by a mutual rack and pinion and cylinder 142. Shaft 124 includes a rack 136 and shaft 126 includes a rack 138. A common pinion gear 140 is disposed between the two racks. Pneumatic cylinder 142 includes a pin 144 that is connected to shaft 124. Upon actuation of pin 144 in the direction indicated by arrow B in FIG. 11, shaft 124 will move towards adjustable stop 146. Because of the rack and pinion, shaft 126 moves in the direction opposite arrow B thereby causing carriage 122 to move in the direction opposite arrow B. The distance the shafts 124, 126 travel is controlled by the position of adjustable mechanical stop 146 and is set according to the bag size.

Figure 12:
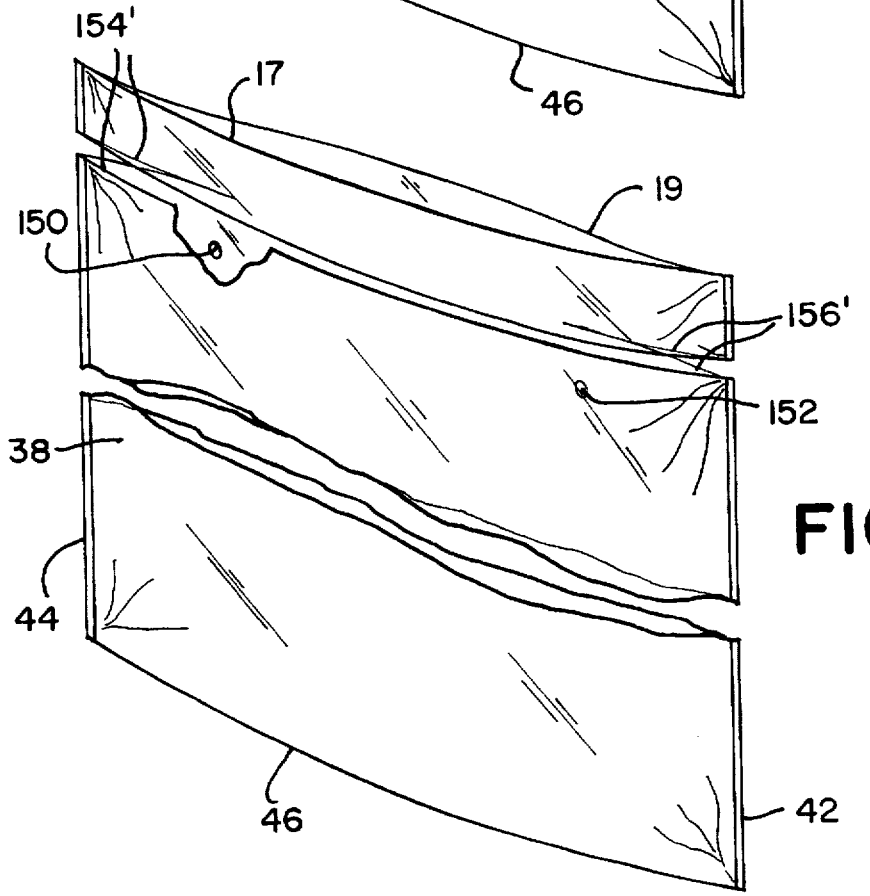
FIG. 12 is a perspective view of the bag after it has been pierced by the bag piercing pins.

Once the bags sides are gripped by the fingers 88, 90, the bag is ready to be opened. The bag is opened by simultaneously actuating air cylinders 84, 86 so that pins 80, 82 move towards the front plate 72, actuating air cylinder 76 so that pin 74 retracts causing front plate 72 to retract, and actuating air cylinder 142 so that pin 144 moves in the direction opposite arrow B thus causing carriages 120, 122 to move towards one another. During the initial forward actuation of pins 80, 82, the top portion 48 of the bottom and top sheet of the bag are held by the chains 26. The pins 80, 82 are actuated by cylinders 84, 86 to push the pins 80, 82 towards the front plate 72. As the pins 80, 82 extend, they clamp bag 38 against front plate 72. As the pins 80, 82 continue to extend, cylinder 76 is actuated to retract front plate 72. Simultaneously, cylinder 142 is actuated to retract pin 144 (in the direction opposite arrow B illustrated in FIG. 11) so that carriages 120, 122 move toward one another. Fingers 88, 90 move towards one another and extend into the open space created between backup plate 70 and front plate 72. During the entire opening step, fingers 88, 90 remain substantially halfway between backup plate 70 and front plate 72. Because the top portion 48 of the back sheet is fixedly held by the in-feed chains 26, as the pins 80, 82 extend they pierce the bottom sheet of the bag forming throughholes 150, 152 in the back sheet as illustrated in FIG. 12. After piercing through the bottom sheet, pins 80, 82 hold the top sheet against front plate 72 as illustrated in FIG. 1. As the pins 80, 82 continue to extend perforations 154, 156, formed in the back sheet, are broken. The broken perforations 154', 156' are illustrated in FIG. 1. The distance that the front plate 72 retracts is limited by adjustable stop 78. The position of the pins 80, 82 is also adjustable according to the preferred bag opening size and are preferably disposed along a vertical line adjacent to and below the inner most end of each perforation 154, 156 as illustrated by the position of throughholes 150, 152 in FIG. 12. Once the top plate 72 has fully retracted and pins 80, 82 are fully extended, the top of bag 38 is now open and ready to be filled. The bag 38 can be top filled either manually or automatically. The top of the bag, as is clearly illustrated in FIG. 1, is now in an open position and forms a neat square or rectangular shaped opening whose size and location is predetermined by the bag, open, fill and seal station 20. The shape of the open top of the bag is not affected by any ambient gusts of air. Thus, the position of the filling device needs to be set once, during the initial set up, and will thereafter reliably dispense contents into the open bag.

After bag 38 has been filled, cylinder 76 is actuated to extend pin 74 to push front plate 72 against backup plate 70. Substantially simultaneously cylinder 142 is actuated to extend pin 144 in the direction indicated by arrow B in FIG. 11, to cause gripper fingers 88, 90 to return to their original position. Additionally, cylinders 84, 86 are deactivated to permit the pins 80, 82 to be pushed back to their original position by front plate 72. The top of bag 38 is now clamped between plates 70, 72 and is ready to be sealed in the manner similar to how the side edges 42, 44 were sealed.

Figure 13:
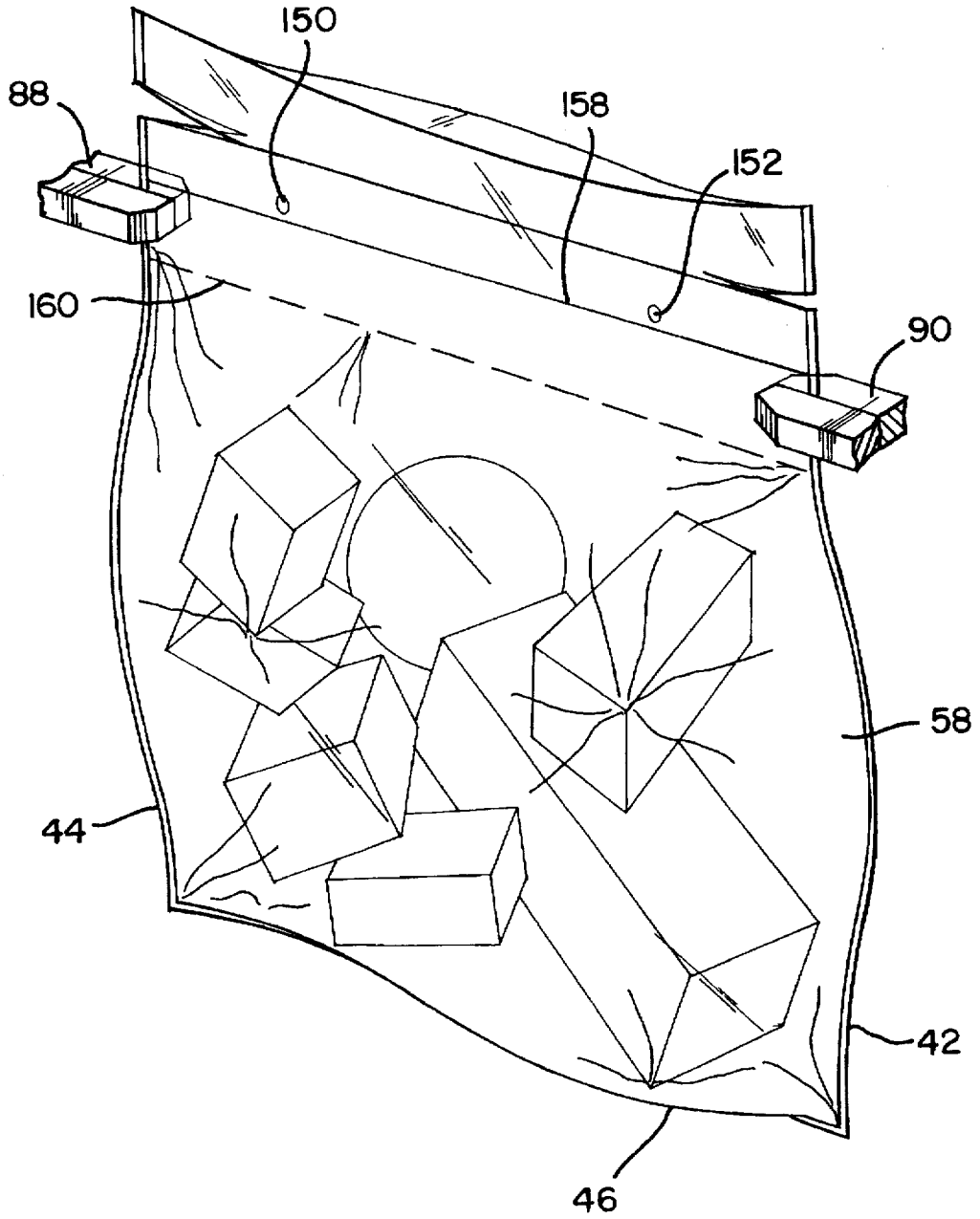
FIG. 13 is a perspective of the bag after it has been filled with contents and is held by the gripping fingers.
Figure 14:
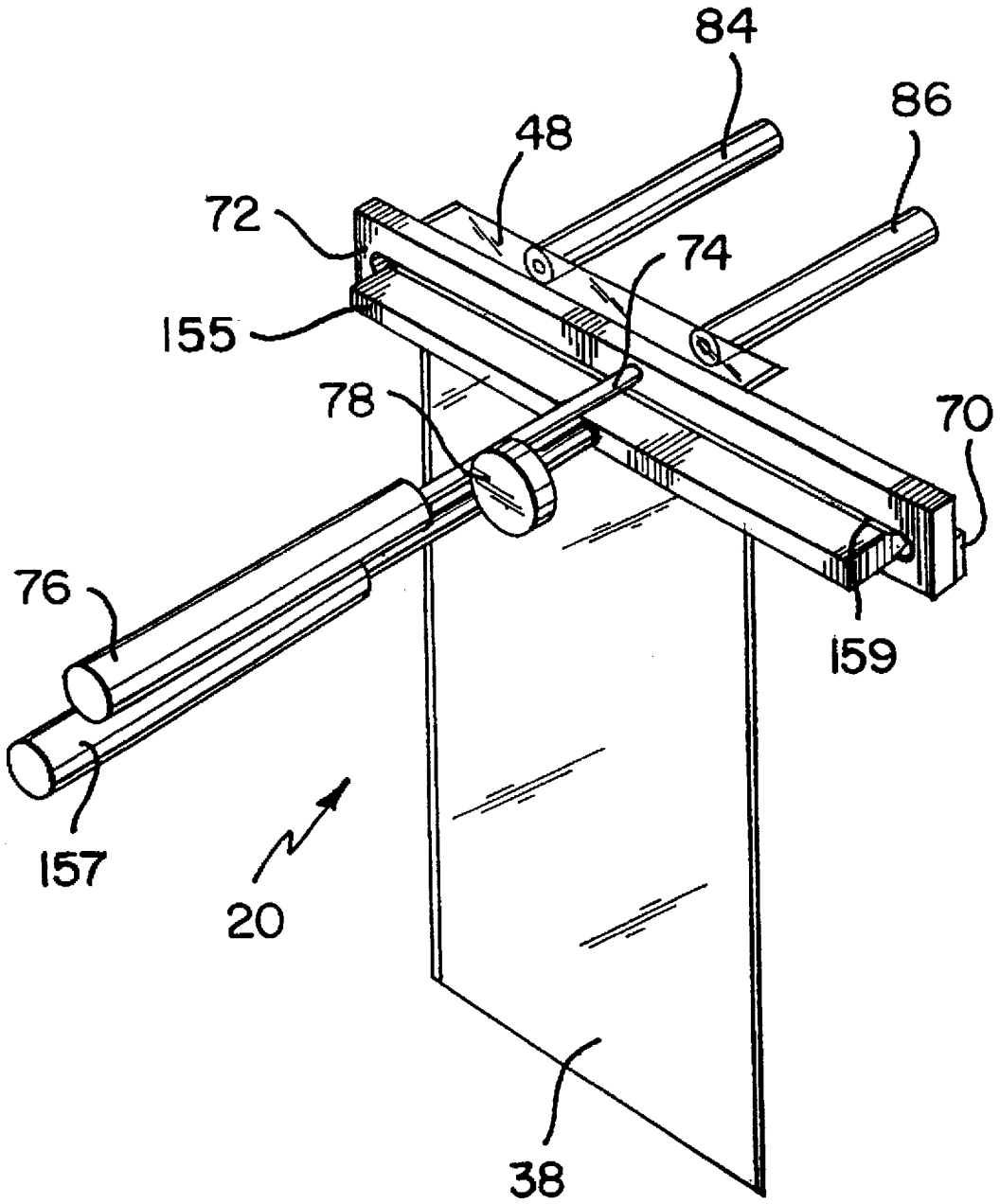
FIG. 14 is a perspective view of the bag as the top seal is being formed.

As illustrated in FIG. 13, the gripping fingers 88, 90 are returned to their original position, thereby closing the top of the bag taut for the sealing operation. The bag 38 is then ready to be sealed by a heat cut and seal blade 155. Heat, cut and seal blade 155 is actuated by pneumatic cylinder 157 so that the heat, cut and seal blade 155 extends forward towards the front plate 72 and through the slot 159 in front plate 72. The bag is then sealed and cut along seal line 158 as illustrated in FIG. 13. The bag will then drop into a box or onto a conveyor for further processing.

Referring now to FIG. 13, it should be noted that the grippers 88, 90 close the top of the fried bag just below seal line 158. Thus, the fingers permit the top of the bag to be clamped fiat between the back plate 70 and the front plate 72 which is disposed slightly above fingers 88, 90. Thus, fingers 88, 90 eliminate substantially all wrinkles and creases that otherwise would be caused by the product in the bag if, for example, the seal line at the top of the bag were to be made below the position of gripper fingers 88, 90 as is indicated by hypothetic seal line 160. Because the contents of the bag would generally cause wrinkles in the shape of the bag below the gripping fingers 88, 90, any seal which is made below gripping fingers 88, 90 is likely to contain wrinkles or creases. The remaining trim piece 48 (i.e., the portion of the bag disposed above seal line 158) is then fed by in-feed chains 28 to a disposal area and the next bag is indexed into the bag open, fill and seal station 20. Of course, the trim piece 48 can be recycled for further use.

Having described the presently preferred exemplary embodiment of an apparatus and method for forming, filling and sealing a bag in accordance with the present invention, it is believed that other modifications, variations and changes will be suggested to those skilled in the art in view of the teachings set forth herein. It is, therefore, to be understood that all such modifications, variations, and changes are believed to fall within the scope of the present invention as defined by the appended claims.

What is claimed is:

1. An apparatus for filling and sealing a bag having a top sheet and a bottom sheet, the bag having a leading edge seal, a trailing edge seal, a bottom edge seal and an open top edge with an upper portion extending therefrom, said apparatus comprising:

a back plate;

a slotted front plate disposed adjacent to said back plate, said slotted front plate and said back plate clamping a portion of said bag disposed below said top edge, said front and back plate extending from said trailing edge to said leading edge;

a pair of pins each having a distal end that moves from a first limit second limit position, in said first limit position said distal end of said pins are spaced from said bottom sheet, in said second limit position said distal end of said pins penetrate through said bottom sheet and clamp said top sheet against said front plate; and a first cut and seal blade disposed adjacent to said slotted front plate for sealing said open top edge of said bag.

2. The apparatus according to claim 1, wherein in said second limit position said slotted front plate is spaced from said back plate.

3. The apparatus according to claim 2, further comprising a pair of gripping fingers, one of said pair of gripping fingers clamping said leading edge adjacent to and below said from plate and said back plate and the other of said pair of gripping fingers clamping said trailing edge adjacent to and below said front plate and said back plate.

4. The apparatus according to claim 3, wherein in said second limit position said pair of gripping fingers are disposed substantially haft way between said back plate and said slotted front plate.

5. The apparatus according to claim 4, wherein, said first cut and seal blade moves from a fast limit position to a second limit position, in said first limit position, said first cut and seal blade is spaced from said slotted front plate, in said second limit position, said first cut and seal blade is disposed in said slotted front plate.

6. The apparatus according to claim 1, further comprising a bag perforator including a plurality of cutting members.

7. The apparatus according to claim 6, wherein said plurality of cutting members moving from a first limit position to a second limit position, in said first limit position said plurality of cutting members are spaced from said bottom sheet, in said second limit position said plurality of cutting members penetrate through said bottom sheet in two spaced apart locations.

8. The apparatus according to claim 7, wherein said two spaced apart locations are colinear, each of said perforations in said spaced apart locations have a length that are approximately equal to one-fourth the width of the bag.

9. The apparatus according to claim 8, further comprising a bag forming station including a second cut and seal blade member, said second cut and seal blade member moves from a first limit position to a second limit position, in said first limit position, said cut and seal blade member is spaced from said top and said bottom sheet, in said second limit position, said second cut and seal blade member contacts said top sheet and said bottom sheet to simultaneously form a trailing edge seal of an upstream bag and leading edge seal of a downstream bag.

10. The apparatus according to claim 9, further comprising a cutter member disposed adjacent to said bag forming station, said cutter member including means for cutting only said top sheet of said bag to form a slit that is disposed substantially parallel to said two colinear spaced apart locations formed by said bag perforator.

11. An apparatus for filling and sealing a bag having a top sheet and a bottom sheet, the bag having a leading edge seal, a trailing edge seal, a bottom edge seal and an open top edge with an upper portion extending therefrom, said apparatus comprising:

a bag perforator including a plurality of cutting members, said plurality of cutting members moving from a first limit position to a second limit position, in said first limit position said plurality of cutting members are spaced from said bottom sheet, in said second limit position, said bottom sheet is in a bottom position and said plurality of cutting members penetrate only through said bottom sheet in two spaced apart locations;

means for opening said bag to permit filling of said bag; and means for sealing said open top edge of said bag.

12. The apparatus according to claim 11, wherein said two spaced apart locations are colinear, each of said perforations in said spaced apart locations have a length that are approximately equal to one-fourth the width of the bag.

13. The apparatus according to claim 12, further comprising a back plate, a slotted front plate disposed adjacent to said back plate, said slotted front plate and said back plate clamping a portion of said bag disposed below said top edge, said front and back plate extending from said trailing edge to said leading edge, a pair of pins each having a distal end that moves from a first limit position to a second limit position, in said first limit position said distal end of said pins are spaced from said bottom sheet, in said second limit position said distal end of said pins penetrate through said bottom sheet and clamp said top sheet against said front plate.

14. The apparatus according to claim 13, wherein in said second limit position said slotted front plate is spaced from said back plate.

15. The apparatus according to claim 14, further comprising a pair of gripping fingers, one of said pair of gripping fingers clamping said leading edge adjacent to and below said front plate and said back plate and the other of said pair of gripping fingers clamping said trailing edge adjacent to and below said front plate and said back plate.

16. The apparatus according to claim 15, wherein in said second limit position said pair of gripping fingers are disposed substantially half way between said back plate and said slotted front plate.

17. The apparatus according to claim 16, further comprising a first cut and seal blade disposed adjacent to said slotted front plate, said first cut and seal blade moves from a first limit position to a second limit position, in said first limit position, said first cut and seal blade is spaced from said slotted front plate, in said second limit position, said first cut and seal blade is disposed in said slotted front plate.

18. The apparatus according to claim 17, further comprising a bag forming station including a second cut and seal blade member, said second cut and seal blade member moves from a first limit position to a second limit position, in said first limit position, said cut and seal blade member is spaced from said top and said bottom sheet, in said second limit position, said second cut and seal blade member contacts said top sheet and said bottom sheet to simultaneously form a trailing edge seal of an upstream bag and leading edge seal of a downstream bag.

19. The apparatus according to claim 18, further comprising a cutter member disposed adjacent to said bag forming station, said cutter member including means for cutting only said top sheet of said bag to form a slit that is disposed substantially parallel to said two colinear spaced apart locations formed by said bag perforator.

20. A method for filling and sealing a bag having a top sheet and a bottom sheet, the bag having a leading edge seal, a trailing edge seal, a bottom edge seal and an open top edge with an upper portion extending therefrom, said method comprising the steps of:

positioning the bag between a back plate and a slotted front plate;

clamping a portion of the bag disposed below the top edge with said front plate and said back plate;

opening the bag by moving a pair of pins from a first limit position where the pins are spaced from the bottom sheet of the bag to a second limit position where the pins penetrate through the bottom sheet and clamp the top sheet against the front plate thereby forming an opening in the top of the bag; and sealing the open top edge of the bag.

21. The method according to claim 20, further comprising the step of clamping the leading edge and the trailing edge of the bag at a position adjacent to and below the front and the back plate with a pair of gripping fingers.

22. The method according to claim 21, further comprising the step of cutting the top edge of the preformed bag.

23. The method according to claim 22, further comprising the step of perforating the bottom sheet of the preformed bag in two spaced apart locations.

24. The method according to claim 23, wherein the two spaced apart locations are colinear, each of the perforations in the spaced apart locations have a length of approximately one-fourth the width of the bag.

25. The method according to claim 24, further comprising the step of cutting a slit in only the top sheet such that the slit is disposed substantially parallel to the perforations in the two spaced apart locations.

* * * * *